United States Patent [19]

Anderson et al.

[11] 4,362,798

[45] Dec. 7, 1982

[54] HYDRAZONE AND PYRAZOLINE OR ACETOSOL YELLOW CONTAINING CHARGE TRANSPORT LAYER, PHOTOCONDUCTOR AND ELECTROPHOTOGRAPHIC PROCESS USING THE SAME

[75] Inventors: Howard W. Anderson; Robert B. Champ, both of Boulder, Colo.

[73] Assignee: International Business Machines Corporation, Armonk, N.Y.

[21] Appl. No.: 264,737

[22] Filed: May 18, 1981

[51] Int. Cl.[3] ..... G03G 5/06; G03G 5/09

[52] U.S. Cl. ..... 430/59; 430/83

[58] Field of Search ..... 430/58, 59, 82, 83

[56] References Cited

U.S. PATENT DOCUMENTS

| | | | |
|---|---|---|---|
| 3,837,851 | 9/1974 | Shattuck et al. | 430/59 |
| 4,018,607 | 4/1977 | Contois | 430/83 X |
| 4,030,923 | 6/1977 | Krause et al. | 96/1.5 |
| 4,150,987 | 4/1979 | Anderson et al. | 96/1.5 R |
| 4,231,799 | 11/1980 | Rochlitz | 430/59 |

FOREIGN PATENT DOCUMENTS

| | | | |
|---|---|---|---|
| 964873 | 7/1964 | United Kingdom | 430/83 |
| 964877 | 7/1964 | United Kingdom | 430/83 |
| 1337228 | 11/1973 | United Kingdom | 430/58 |

*Primary Examiner*—Roland E. Martin, Jr.
*Attorney, Agent, or Firm*—Francis A. Sirr

[57] ABSTRACT

A process for electrophotographic reproduction, and a layered electrophotographic plate having a conventional charge generation layer and a p-type hydrazone containing charge transport layer, in which the surface of the charge transport layer is selectively discharged by actinic radiation as a result of the migration through the transport layer of charges generated in the charge generation layer as a result of the actinic radiation and injected into the transport layer, the hydrazone having the composition p-diethylaminobenzaldehyde-(diphenylhydrazone), i.e., and the charge transport layer including DEASP or Acetosol Yellow in an amount not exceeding 13 wt. % of the hydrazone.

2 Claims, 1 Drawing Figure

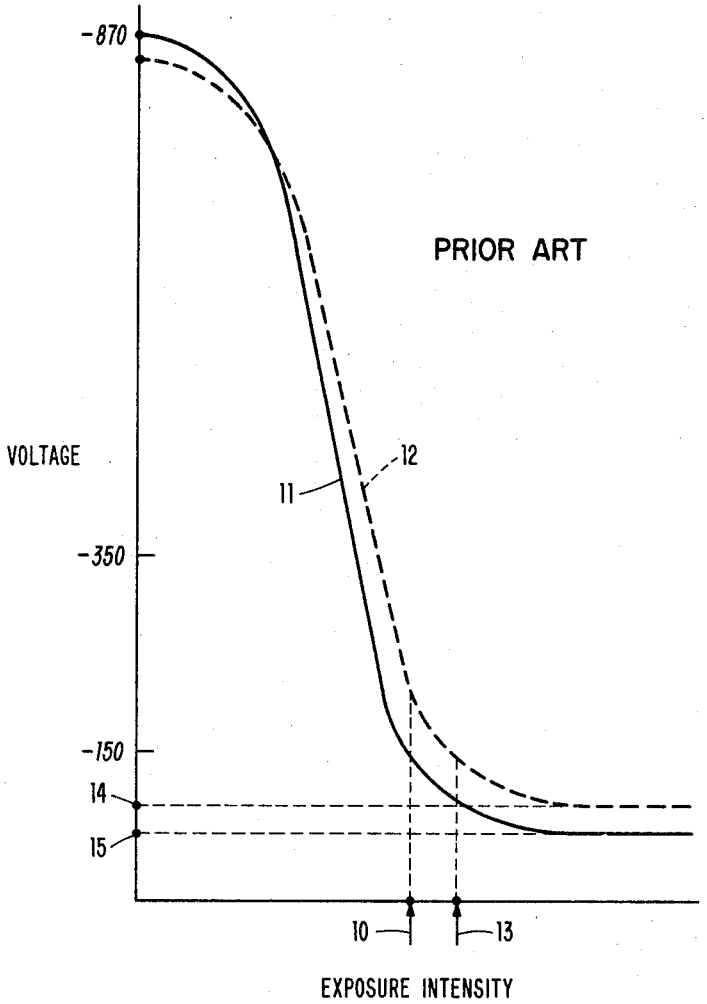
-870
PRIOR ART
VOLTAGE
12
11
-350
-150
14
15
10
13
EXPOSURE INTENSITY

HYDRAZONE AND PYRAZOLINE OR ACETOSOL YELLOW CONTAINING CHARGE TRANSPORT LAYER, PHOTOCONDUCTOR AND ELECTROPHOTOGRAPHIC PROCESS USING THE SAME

DESCRIPTION

Technical Field

The invention pertains to photographic chemistry, processes and materials, and particularly to layered electrophotographic elements, process and materials.

Background of the Invention

U.S. Pat. No. 4,150,987, which is incorporated herein by reference, describes a layered electrophotographic plate or element having a conventional charge generating layer and a charge transport layer containing p-type hydrazone.

While the invention defined by this patent is a particularly good photoconductor for use in the xerographic reproduction process, it has been found that prolonged exposure to ambient light, and particularly to cool white fluorescent light usually found in offices, causes the photoconductor to lose its photosensitivity.

This characteristic is not a problem when the xerographic copier is a high speed duplicator, since experienced, well trained operators do not expose the photoconductor to ambient light for prolonged periods. However, use of this photoconductor in low speed copiers can create problems since such copiers are usually attended by operators having little or no training.

More specifically, the electrophotographic element of the aforesaid patent which contains the preferred hydrazone molecule p-diethylaminobenzaldehyde-(diphenylhydrazone), called DEH, i.e.

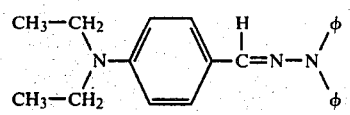

has been found to experience an undesirable change in light sensitivity when exposed to conventional cool white fluorescent room light for 15 minutes or more.

The FIGURE is useful in explaining this change in light sensitivity.

The Invention

The present invention substantially eliminates the aforesaid ambient light fatigue of U.S. Pat. No. 4,150,987's photoconductor by incorporating a small amount of 1-phenyl-3[p-diethylaminostyryl]-5-[p-diethylaminophenyl]-pyrazoline, hereinafter DEASP, i.e.

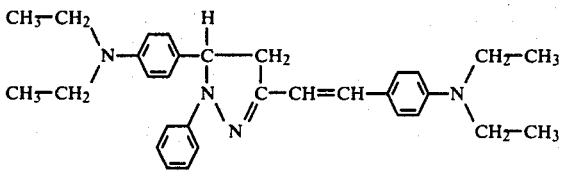

or the brand Acetosol Yellow dye by Sandoz Chemical Company, in the hydrazone charge transport layer of that photoconductor. Exemplary photoconductors in accordance with the present invention were tested having 5 wt.% DEASP, 3.3 wt. % Acetosol Yellow and 13 wt. % Acetosol Yellow. Testing of these examples leads to the conclusion that DEASP or Acetosol Yellow may be used in an amount not exceeding 13 wt. % of the active charge transport hydrazone material. These tests also show that DEASP is preferred, and its preferred amount is about 5 wt. %.

The unexpected and surprising effect which results from adding near-trace amounts of these materials to the hydrazone transport layer is not understood with certainty. However, it may be that the materials act to filter the portion of ambient light's wavelength which adversely affects this particular hydrazone molecule. This hydrazone molecule has a peak sensitivity at about 3670 angstroms. One would expect that a filter should operate at this wavelength. DEASP and Acetosol Yellow, however, have a peak absorption in the range of about 4100 to 4200 angstroms; thus, it is surprising that trace amounts of these materials operate to substantially reduce the light fatigue of this electrophotographic element.

Use of DEASP, a tri-aryl pyrazoline, as the active charge transport material in a layered photoconductor is known from U.S. Pat. No. 4,030,923 for example. However, it was unexpected and unknown that small amounts of DEASP or Acetosol Yellow would substantially eliminate ambient light fatigue of a photoconductor whose active charge transport layer molecule is the aforementioned hydrazone.

Comparative Examples

In order to provide a basis of comparison, a first comparative example, layered photoconductor was prepared and tested as follows. This photoconductor comprised a 0.003 inch thick aluminized Mylar (a brand of polyester film by E. I. du Pont de Nemours & Co.), flexible substrate whose aluminum surface was coated with an initial adhesive sublayer. This adhesive sublayer was then coated with a charge generation layer, and lastly, the charge transport layer was coated onto the charge generation layer.

More specifically, the sublayer comprised a solution of PE-200 and THF (tetrahydrofuran) solvent, and was coated to a thickness of about 0.15 microns onto the substrate's aluminum surface. PE-200 is a B. F. Goodrich Chemical Company brand of polyester resin.

A solution of CDB (chlorodiane blue, a disazo dye) in a solvent mixture of about 25 weight % ethylenediamine, about 50 weight % n-butylamine and about 25 weight % THF was then coated over the sublayer to a dry thickness of about 0.1 micron. This charge generating layer was oven cured.

The charge transport layer comprised a solution of about 40 weight % DEH (diphenylhydrazone) using Merlon M-60 (Mobay Chemical Co.) polycarbonate resin as the binder and THF as the solvent. This solution was coated to a dry thickness of about 15 microns.

The layered photoconductor, prepared as above described was then tested, without exposure to room light, in a sensitometer which simulated the IBM Series III copier/duplicator. This sensitometer was fitted with electrostatic probes in order to measure the voltage magnitude of the photoconductor's latent electrostatic image, thereby enabling measurement of sensitivity, dark fatigue, residual potential and dark decay. This sensitometer included a corona charging source designed to charge the photoconductor to about −870 V, and an illumination source whose intensity matches the light reflected to the Series III copier's photoconductor from the white area of an original document. The IBM Series III copier/duplicator also charges its photoconductor to about −870 V, and includes a magnetic brush developer whose development electrode voltage is about −350 V. In order to produce high quality copies, this copier discharges the white area of the photoconductor to about −150 V.

Photosensitivity is defined as the amount of light energy in microjoules/cm$^2$ required to reduce the photoconductor's voltage from its initial charge of about −870 V to −150 V, with the light energy originating from a tungsten halogen lamp having a cutoff filter for the red portion of the spectrum, and whose maximum wavelength spectral output occurs at about 6000 angstroms. As a photoconductor's sensitivity gradually decreases (i.e., as more intense light would be necessary to properly discharge the white area of the photoconductor's latent image, but is not actually available since the sensitometer's illumination intensity remains constant), the voltage sensed by the sensitometer begins to show higher voltages in the white area. This higher voltage indicates loss of photoconductor sensitivity.

Dark fatigue is defined as the change in the ability to charge the photoconductor to −870 V after the photoconductor has been used to prepare 1000 copies in a continuous copy run. For example, the photoconductor's fully-charged voltage may measure −870 V at the beginning of the copy run, and only −820 V at the end of the run, this being a dark fatigue of +50 V. As a photoconductor experiences more and more dark fatigue, the black-charge portion of the photoconductor's latent image reduces in magnitude (becomes less negative in the present case), approaching the development electrode voltage, and the black toner image on the copy sheets appears washed-out or less black.

Light fatigue is defined as the change in the ability to discharge the photoconductor by exposure to light reflected from the white background of an original document after being copied 1000 times. For example, the photoconductor's voltage may measure −170 V at the beginning of the copy run, and −190 V at the end of the run, this being a light fatigue of −20 V. As a photoconductor experiences more and more light fatigue, the white-charge portion of the photoconductor's latent image approaches the development electrode voltage (becomes more negative in the present case), and the white copy paper begins to pick up unwanted toner in the area which should remain paper-white.

Residual potential is defined as the lowest voltage to which the photoconductor, initially charged to −870 V, can be discharged by increasing the intensity of the exposure light source. The residual potential of a photoconductor is important in that it is a measure of the ability to discharge the photoconductor in its nonworking area, i.e., the area which never carries a latent image to be reproduced as a copy. These nonworking areas are, for example, the photoconductor's interimage area. Such an area is fully charged, but is intentionally erased by lamps which are mounted closely adjacent the photoconductor, before these areas pass through the developing station. As the residual potential increases (becomes more negative in the present case), the nonworking areas undesirably pick up more toner at the developing station, which toner must then be cleaned from the photoconductor at the cleaning station.

Dark decay is defined as the rate of change in volts per second of the photoconductor's original charge of −870 V which occurs as the charged photoconductor is left in total darkness for an extended period of time. As dark decay increases, it is found that the black area of the latent image is reduced in magnitude at the developer station (becomes less negative in the present case), and the black area of the copy begins to appear washed out.

These properties were measured for two samples of the comparative example, with the following results (sensitivity is expressed in microjoules per square centimeter):

| Sample | Sensitivity | Dark Fatigue | Light Fatigue | Residual Potential | Dark Decay |
|---|---|---|---|---|---|
| 1 | 1.7 | +48V | +14V | −45V | 34 |
| 2 | 1.7 | +39V | +2V | −51V | 22 |

These two samples of the comparative example were then placed in ambient room light for 30 minutes and the above sensitometer test was repeated. The ambient room light was cool white fluorescent of about 120 millijoules/cm$^2$ intensity at the photoconductor samples. The test results were as follows:

| Sample | Sensitivity | Dark Fatigue | Light Fatigue | Residual Potential | Dark Decay |
|---|---|---|---|---|---|
| 1 | 1.87 | +16V | −13V | −57V | 24 |
| 2 | 1.88 | +21V | −31V | −73V | 23 |

For the above tests it can be seen that the photoconductor's sensitivity is reduced appreciably (i.e., more light energy is needed to discharge the photoconductor to −150 V). As a result, the copy sheet white area can be expected to contain unwanted background toner.

The figure shows the effect of this change in photoconductor sensitivity relative the operating parameters of the IBM Series III copier/duplicator. In this figure the voltage level of −150 V is the desired voltage of the white area of the photoconductor's latent image when the photoconductor is subjected to the reflected illumination intensity from an original document's white background area. The copier's document illumination intensity is of course constant, and this intensity is represented by the exposure intensity designated by reference numeral 10.

Curve 11 represents comparative samples 1 and 2, both having an initial sensitivity of 1.7 microjoules/cm$^2$ (i.e., the figure's exposure intensity 10) which reduces the photoconductor's initial charge of −870 V to −150 V, as desired and as shown by curve 11.

Dotted curve 12 represents, for example, comparative sample 2 after this sample was placed in ambient room light for 30 minutes. As can be seen, a higher exposure intensity, represented by 13, would now be required in the Series III copier in order to reduce the white area of the photoconductor's latent image to the desired −150 V. In actual practice, exposure intensity remains constant in the copier at 10. Thus, the true white area voltage is represented by a more negative point on curve 12. Note that the differential between the white area voltage and the magnetic brush bias voltage of −350 V has now decreased. A decrease of significant magnitude shows up on the copy paper as unwanted background toner in the copy area which should be paper-white, as it is when the photoconductor's white area voltage is −150 V.

In this exemplary figure, the change in exposure intensity represented by points 10 and 13 is a measure of a change in sensitivity. The change in residual potential is represented by points 14 and 15.

Example I

Two samples of a layered photoconductor were then prepared in accordance with the present invention, following the procedure of the comparative example, but adding 5 weight % of DEASP to the transport layer.

The above described sensitometer tests were again conducted. The test results obtained from use of the photoconductor which was not preceded by roomlight exposure were as follows:

| Sample | Sensitivity | Dark Fatigue | Light Fatigue | Residual Potential | Dark Decay |
|---|---|---|---|---|---|
| 3 | 1.64 | +50V | +18V | −86V | 21 |
| 4 | 1.7 | +48V | +23V | −93V | 21 |

The test results obtained after exposure to room light as above mentioned was as follows:

| Sample | Sensitivity | Dark Fatigue | Light Fatigue | Residual Potential | Dark Decay |
|---|---|---|---|---|---|
| 3 | 1.62 | +30V | −10V | −96V | 24 |
| 4 | 1.7 | +28V | +8V | −99V | 26 |

The results of this test show that, quite unexpectedly, substantially no change in light sensitivity occurs as a result of the addition of a small amount of DEASP.

EXAMPLE II

A sample of a layered photoconductor was also prepared in accordance with the present invention, following the procedure of the comparative example, but adding 3.3 weight % of Acetosol Yellow to the transport layer.

The sensitometer tests were repeated, but only sensitivity and dark decay were measured. The test results obtained from use of the photoconductor not exposed to room light was as follows:

| Sample | Sensitivity | Dark Decay |
|---|---|---|
| 5 | 1.36 | 49 |

The sample was then exposed to room light as above defined for times of 5, 15 and 30 minutes, and again tested, with the following results:

| Exposure Time | Sensitivity | Dark Decay |
|---|---|---|
| 5 min. | 1.41 | 59 |
| 15 min. | 1.46 | 64 |
| 30 min. | 1.60 | 75 |

Again it is seen that sensitivity does not appreciably change, provided the time period does not exceed about 15 minutes.

EXAMPLE III

Another sample of a layered photoconductor in accordance with the present invention was prepared following the procedure of the comparative example, but adding 13 wt. % of Acetosol Yellow. Again, this weight percent is the percent of the total weight of the active charge transport material.

More specifically, in this case, the charge transport layer comprised 34 parts Merlon M-60 polycarbonate, 16 parts PE-200 polyester (a product of Goodyear Chemical Co.), 10 parts A-11 acrylic (a product of Rohm & Haas Co.), 5.2 parts Acetosol Yellow GLS (a product of Sandoz Chemical Co.) and 34.8 parts DEH.

The sensitometer tests were repeated, measuring sensitivity, dark fatigue and light fatigue, with the following results:

| Sample | Light Exposure | Sensitivity | Dark Fatigue | Light Fatigue |
|---|---|---|---|---|
| 6 | None | 1.58 | 73V | 49V |
| 6 | 15 Minutes | 1.29 | 16V | −11V |
| 6 | 30 Minutes | 1.27 | −6V | −33V |

As can be seen a weight percent of about 13% Acetosol Yellow establishes the limiting range of the present invention by virtue of a beginning trend of change in sensitivity with exposure to light of as much as 15 minutes. With increasing concentrations of this additive, one observes an increasing change in sensitivity upon exposure to room light. Dark fatigue and light fatigue continue to go negative upon prolonged room light exposure.

While the invention has been particularly shown and described with reference to preferred embodiments thereof, it will be understood by those skilled in the art that various changes in form and details may be made therein without departing from the spirit and scope of the invention.

What is claimed is:

1. In an electrophotographic element comprising:

an electrically conductive layer;

a charge generation layer responsive to actinic radiation to generate an electron-hole pair; and a p-type charge transport layer adjacent the charge generation layer, the charge transport layer comprising a hydrazone of the composition p-diethylaminobenzaldehyde(diphenylhydrazone), i.e.:

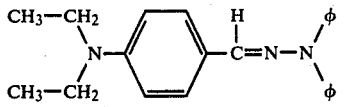

and a polymeric binder;

whereby holes generated by photoelectric phenomenon in the charge generation layer may be transported through the charge transport layer to facilitate localized selective discharge of charged surfaces of the element, the improvement comprising:

the addition of [DEASP or Acetosol Yellow] 1-phenyl-3[p-diethylaminostyryl]-5-[p-diethylaminophenyl]-pyrazoline to said charge transport layer in an amount which is effective to produce the result that the photosensitivity of the photoconductor is not appreciably affected by exposure to limited amounts of ambient light.

2. The electrophotographic element of claim 1 wherein [DEASP] 1-phenyl-3[p-diethylaminostyryl]-5-[p-diethylaminophenyl]-pyrazoline is added in the amount of about 5 wt. % of said hydrazone.

* * * * *

UNITED STATES PATENT AND TRADEMARK OFFICE

CERTIFICATE OF CORRECTION

PATENT NO. : 4,362,798

DATED : December 7, 1982

INVENTOR(S) : Howard W. Anderson and Robert B. Champ

It is certified that error appears in the above—identified patent and that said Letters Patent is hereby corrected as shown below:

Column 6,
Claim 1, line 57, delete "[DEASP or Acetosol Yellow]";

line 65, delete "[DEASP]".

Signed and Sealed this

First Day of February 1983

[SEAL]

Attest:

GERALD J. MOSSINGHOFF

Attesting Officer

Commissioner of Patents and Trademarks